US005592913A

United States Patent [19]

Matthews

[11] Patent Number: 5,592,913

[45] Date of Patent: Jan. 14, 1997

[54] EXHAUST VALVE WITH A TAPERED STEM PORTION

[75] Inventor: William F. Matthews, Lafayette, Ind.

[73] Assignee: Caterpillar Inc., Peoria, Ill.

[21] Appl. No.: 625,501

[22] Filed: Mar. 29, 1996

[51] Int. Cl.[6] ..... F01L 3/02

[52] U.S. Cl. ..... 123/188.3; 123/188.9; 123/188.11

[58] Field of Search ..... 123/188.3, 188.9, 123/188.11, 188.1

[56] References Cited

U.S. PATENT DOCUMENTS

| | | | |
|---|---|---|---|
| 1,615,211 | 1/1927 | Bissell | 123/188.3 |
| 2,070,102 | 2/1937 | Weslake | 123/188 |
| 2,119,042 | 5/1938 | Charlton | 123/188 |
| 2,286,009 | 6/1942 | Powe | 123/188.9 |
| 2,367,783 | 1/1945 | Kerwin et al. | 29/156.7 |
| 2,373,459 | 4/1945 | Colwell | 51/290 |
| 2,403,260 | 7/1946 | Charles | 123/188.9 |
| 2,450,817 | 10/1948 | Sterling | 29/76 |
| 3,233,599 | 2/1966 | Schober | 123/41.16 |
| 3,345,976 | 10/1967 | Pope et al. | 123/188.9 |
| 4,073,474 | 2/1978 | Hashimoto et al. | 251/368 |
| 4,200,066 | 4/1980 | Berchtold | 123/188.9 |
| 4,881,500 | 11/1989 | Kojima et al. | 123/188 |
| 4,928,645 | 5/1990 | Berneburg et al. | 123/188 |
| 5,081,965 | 1/1992 | Walters et al. | 123/188 |

FOREIGN PATENT DOCUMENTS

| | | | |
|---|---|---|---|
| 62-96707 | 5/1987 | Japan | 123/188.9 |

*Primary Examiner*—Erick R. Solis
*Attorney, Agent, or Firm*—Fred J. Baehr

[57] ABSTRACT

An exhaust valve with a tapered stem portion has a head portion with a frustoconical seat portion and a trumpet like portion which extends from the seat portion to a tapered portion, a stem portion has a cylindrical portion which fits within a valve guide bore and a tapered portion, which adjoins the tapered portion of the head portion at a weld to form a continuous smooth taper, the weld is always disposed within the valve guide bore to prevent scuffing and seizure at inlet of the valve guide bore due to differential thermal expansion between the head and stem portions as they are formed of different alloys.

5 Claims, 1 Drawing Sheet

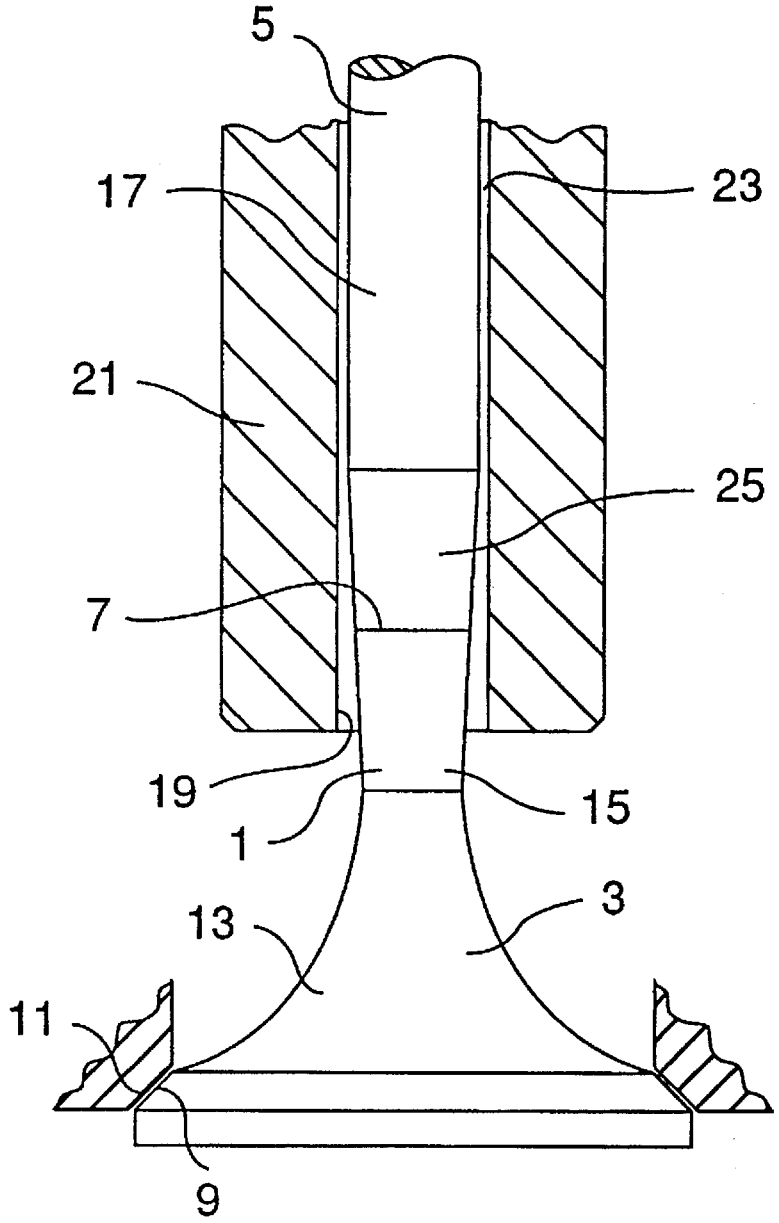
5
17
23
21
25
7
19
15
1
3
13
11
9

EXHAUST VALVE WITH A TAPERED STEM PORTION

TECHNICAL FIELD

The invention relates to an exhaust valve for an internal combustion engine and more particularly to a tapered stem portion adjacent to the end of a valve guide to prevent interference between the valve stem and the valve guide.

BACKGROUND ART

Exhaust valves of high compression internal combustion engines are subjected to extremely high temperatures and corrosive exhaust gases. Furthermore the exhaust valves are subjected to strong tensile and bending stresses at the neck portion due to the spring forces applied by valve springs. As described in U.S. Pat. No. 4,073,474 to control cost and improve performance only the head portion of the valve is made of a high temperature alloy and the remaining stem portion is made of a conventional valve steel and the head and stem portions are joined by friction welding after the valve head portion is forged. A hard seat material is overlaid on the seat portion of the head portion and the valve is ground to its finished shape.

SUMMARY OF THE INVENTION

Among the objects of the invention may be noted the provision of an exhaust valve with a head portion made of a high temperature alloy welded to a stem portion made of a conventional valve material. These two materials have different coefficients of thermal expansion. The weld area is disposed within a valve guide bore and the area of the valve adjacent the weld is designed to prevent interference between the valve stem portion and the valve guide bore at operating temperature.

In general, an exhaust valve with a tapered stem portion for an internal combustion engine, when made in accordance with this invention, has a generally cylindrical stem portion adapted to fit within a bore of a valve guide and formed of one material. A head portion has a generally frustoconical seat portion. The head portion is formed of a different material, which will withstand high exhaust temperatures. The stem and head portions are welded together. The invention is characterized in that a portion of the stem and a portion of the head adjacent the weld form a taper. The taper generally extends an equal distance on each side of the weld and decreases in diameter from the stem end of the taper to the head end of the taper, whereby thermal growth of the head portion will not interfere with the valve guide bore as the valve opens and closes during the operation of the engine.

BRIEF DESCRIPTION OF THE DRAWINGS

The invention as set forth in the claims will become more apparent by reading the following detailed description in conjunction with the accompanying drawing in which the:

Sole FIGURE is a partial sectional view of an exhaust valve disposed in a valve guide.

DESCRIPTION OF THE PREFERRED EMBODIMENT

Referring now to the sole FIGURE in detail there is shown an exhaust valve 1 for an internal combustion engine (not shown). The exhaust valve 1 has a head portion or head

3 and a stem portion or stem 5 welded together forming a weld or juncture area 7.

The head portion 3 has a frustoconical seat portion 9, which engages a frustoconical seat portion 11 in a portion of an engine head disposed within the engine. The exhaust valve 1 is shown in its seated or closed position. A trumpet like portion 13 of the head 3 extends radially inwardly and longitudinally from the frustoconical seat portion 9 of the head 3 to a tapered portion 15. The tapered portion 15 of the head 3 tapers radially outwardly from the small diameter end of the trumpet like portion 13 to the weld juncture 7.

The stem portion 5 has a generally constant diameter or cylindrical portion 17 disposed within a bore 19 of a valve guide 21. There is a clearance or sliding tolerance 23 between the cylindrical portion 17 of the stem 5 and the valve guide bore 19, which is maintained during the operation of the engine. The stem portion 5 also has a tapered portion 25. The tapered portion 25 of the stem 5 tapers radially inwardly as it extends from the cylindrical portion 17 to the weld juncture 7.

The head tapered portion 15 and the stem tapered portion 25 join at the weld juncture 7 to form a smooth continuous taper, which extends generally the same distance on both sides of the weld juncture 7.

The head portion 3 is formed of a suitable heat resistant alloy, an example of such an alloy has a designation SAE J775 No. EV15 & 16. The frustoconical seat portion 9 is overlaid with a wear resistant alloy material, an example of a suitable material is a chrome nickel alloy called Eatonite 6. The stem portion 5 is formed from a conventional valve alloy, an example of which has a designation SAE 4140. The head portion 3 and the stem portion 5, therefore have different coefficients of thermal expansion and are also exposed to different temperatures, further increasing their differential thermal expansion.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

INDUSTRIAL APPLICABILITY

The exhaust valve 1 advantageously provides a taper adjacent both sides of the head to stem weld 7 to provide sufficient clearance to eliminate scuffing and seizure at the hot region adjacent the inlet to the valve guide 21 due to differential thermal expansion of the valve head and valve stem material. The cylindrical stem portion 17 maintains valve stem to valve guide bore clearance in the cooler stem area to extend exhaust valve and valve guide life, to increase reliability and to reduce maintenance on the engine.

What is claimed is:

1. An exhaust valve for an internal combustion engine having a generally cylindrical stem portion adapted to fit in a bore of a valve guide and formed of one alloy and a head portion having a generally frustoconical seat portion, the head portion being formed of another alloy, which will withstand high exhaust temperatures, the stem and head portions being welded together, the exhaust valve being characterized in that a portion of the stem and a portion of the head adjacent the weld form a taper, which extends longitudinally on each side of the weld and decreases in diameter from the stem end of the taper to the head end of the taper and the weld area between the head portion and the stem portion is always disposed within the bore of the valve guide when the valve is disposed in the engine, whereby thermal growth of the head portion due to differential thermal expansion will not interfere with the valve guide bore as the valve opens and closes during the operation of the engine.

2. An exhaust valve as set forth in claim 1 further characterized by the taper extending generally an equal distance on each side of the weld area between the head and stem portions.

3. An exhaust valve as set forth in claim 1 further characterized in that the head portion extends longitudinally and radially inwardly in a generally trumpet like shape from the frustoconical seat portion to one end of the taper.

4. An exhaust valve as set forth in claim 1 further characterized in that the frustoconical seat portion of the head is overlaid with a hard, wear resistant alloy.

5. An Exhaust valve as set forth in claim 1 further characterized in that the cylindrical portion of the stem maintains a clearance with the valve guide bore.

* * * * *